US012129867B2

(12) United States Patent
Sivaramakrishnan et al.

(10) Patent No.: US 12,129,867 B2
(45) Date of Patent: Oct. 29, 2024

(54) FAN FOR A HEAT EXCHANGER OF A VEHICLE

(71) Applicant: HANON SYSTEMS EFP DEUTSCHLAND GMBH, Bad Homburg v.d. Höhe (DE)

(72) Inventors: Anand Sivaram Sivaramakrishnan, Griesheim (DE); Ahmet Erhan Dinc, Frankfurt a.M. (DE); Mihai Bleiziffer, Worms (DE)

(73) Assignee: HANON SYSTEMS EFP DEUTSCHLAND GMBH, Bad Homburg V.D. Höhe (DE)

( * ) Notice: Subject to any disclaimer, the term of this patent is extended or adjusted under 35 U.S.C. 154(b) by 0 days.

(21) Appl. No.: 18/463,083

(22) Filed: Sep. 7, 2023

(65) Prior Publication Data

US 2024/0141921 A1 May 2, 2024

(30) Foreign Application Priority Data

Oct. 27, 2022 (DE) ..... 10 2022 211 407.8
May 2, 2023 (DE) ..... 10 2023 204 020.4

(51) Int. Cl.
*F04D 29/70* (2006.01)
*F04D 19/00* (2006.01)
*F04D 29/52* (2006.01)

(52) U.S. Cl.
CPC ..... *F04D 29/522* (2013.01); *F04D 19/002* (2013.01); *F04D 29/703* (2013.01)

(58) Field of Classification Search
CPC ..... F04D 29/522; F04D 19/002; F04D 29/703
See application file for complete search history.

(56) References Cited

U.S. PATENT DOCUMENTS

| | | | | |
|---|---|---|---|---|
| 2,950,859 | A * | 8/1960 | Kirk | F04D 29/703 416/247 R |
| 5,466,120 | A | 11/1995 | Takeuchi et al. | |
| 7,594,798 | B1 * | 9/2009 | Bucher | F04D 29/701 415/121.2 |
| 2008/0160898 | A1 * | 7/2008 | Pfannenberg | F04D 29/547 454/184 |
| 2010/0221114 | A1 * | 9/2010 | Do | F03D 3/061 416/193 A |
| 2015/0147161 | A1 * | 5/2015 | Crawford | F04D 29/703 415/121.2 |
| 2017/0114803 | A1 * | 4/2017 | Miwa | H05K 7/20145 |
| 2022/0290680 | A1 * | 9/2022 | Metcalf | F04D 29/703 |
| 2022/0357072 | A1 * | 11/2022 | Zaki | F04D 29/703 |

FOREIGN PATENT DOCUMENTS

| | | | |
|---|---|---|---|
| CN | 109973435 | A | 7/2019 |
| EP | 1458982 | B1 | 11/2007 |
| KR | 20070081355 | A | 8/2007 |

* cited by examiner

*Primary Examiner* — Aaron R Eastman
(74) *Attorney, Agent, or Firm* — Shumaker, Loop & Kendrick, LLP; James D. Miller

(57) ABSTRACT

A fan for a heat exchanger of a vehicle includes a ventilator and a protection grid upstream of the ventilator. The protection grid may include a plurality of radial and/or concentric ribs, wherein at least one rib, in particular a radial one, may have an oval cross-section. A longitudinal axis of the oval may have an angle with respect to the flow direction.

10 Claims, 3 Drawing Sheets

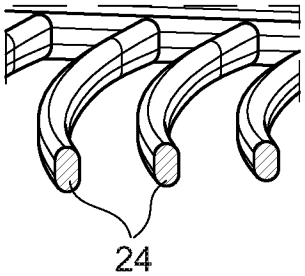
Fig. 3
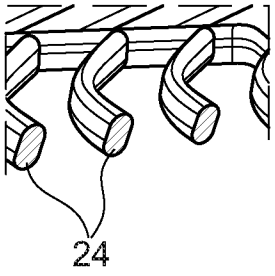
Fig. 4
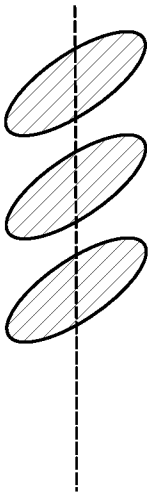
Fig. 5
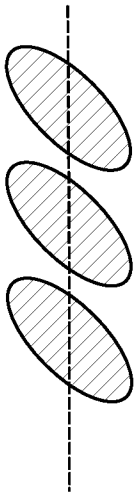
Fig. 6
Fig. 10
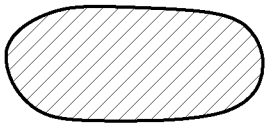
Fig. 11
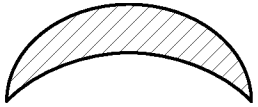
Fig. 12

FAN FOR A HEAT EXCHANGER OF A VEHICLE

CROSS-REFERENCE TO RELATED PATENT APPLICATIONS

This patent application claims priority to German Patent Application No. 10 2023 204 020.4 filed on May 2, 2023 and German Patent Application No. 10 2022 211 407.8 filed on Oct. 27, 2022, the entire disclosures of each of which are hereby incorporated herein by reference.

TECHNICAL FIELD

The invention relates to a fan for a heat exchanger of a vehicle.

BACKGROUND

In heat exchangers, in particular coolers or radiators of a vehicle, it is advantageous in terms of flow if a fan is provided upstream thereof which essentially creates the air flow in the direction of the heat exchanger, for example during standstill, or increases or supports the air flow when the vehicle is moving. However, it is to be ensured with regard to such a fan that the additional noise generation remains within acceptable limits.

An air condition with a fan provided upstream is known from KR20070081355A.

SUMMARY

Against the above-stated background, the invention is based on the object of creating a fan for a heat exchanger of a vehicle, which is well protected and has a comparatively low noise generation.

This object is solved by means of the subject matter shown and described herein.

Accordingly, the fan according to the invention comprises a protection grid upstream of the ventilator, which advantageously prevents stones or other objects from getting into a ventilator of the fan and, in the worst case, damaging or destroying it. As will be explained in detail below, the protection grid according to the invention can at the same time be designed advantageously in such a way that the noise generation remains within acceptable limits. Furthermore, the ventilator can improve the flow to the heat exchanger.

In particular for the stability of the protection grid, it has turned out to be advantageous if it comprises a plurality of radial and/or concentric ribs.

As regards noise due to air flow through the protection grid, an oval cross-section is preferred for at least one rib, in particular one radial rib, but preferably all radial and also concentric ribs. In particular, it can be aligned favorably in terms of flow if a longitudinal axis of the oval extends essentially in the flow direction, i.e. parallel to the axis of the ventilator.

However, it has turned out during first tests that an alignment of the oval cross-section in such a way that the longitudinal axis of the oval has a, preferably acute, angle to the flow direction results in comparatively low noise generation.

This equally applies to a cross-section of at least one, preferably a plurality of, particularly concentric ribs in such a way that it is configured essentially in a crescent shape or asymmetrical, oval shape. In particular, the cross-section may resemble the profile of an aircraft wing.

This is manifested in particular in the preferred measure according to which the oval cross-section is asymmetrical with regard to the position and/or the extent of the bulge on the upper and lower sides if the longitudinal axis is aligned horizontally.

As regards the dimensions of at least one rib, preferably all ribs, of the protection grid, in cross-section a width of 4.0 mm to 4.2 mm, in particular approximately 4.11 mm, and/or a height of 6.0 mm to 6.4 mm, in particular approximately 6.2 mm, has turned out to be favorable. In this regard, the height extends essentially in the flow direction, and the width perpendicular thereto. Moreover, more than 10 mm, in particular 10 to 20 mm, are preferred for the distance to the ventilator. As regards the inclination of the ribs, good properties are expected for +−45° from the main flow axis, in other words the axial axis of the ventilator.

In first tests, it has furthermore turned out that an acceptable noise generation results from the measure, according to which a number of radial ribs is different from a number of blades of the ventilator.

This applies equally to an inclined, curved or crescent-shaped configuration of at least one radial rib, preferably all radial ribs, in particular if the inclination/curved shape/crescent shape is configured in a different direction than a curve of the blades of the ventilator.

When designing a plurality of ribs with an oval cross-section, it is furthermore preferred in terms of flow that the longitudinal axes of a plurality of, preferably all, oval cross-sections are parallel to each other.

Finally, it can be advantageous in certain cases of application if the protection grid according to the invention as a whole extends so as to be curved at least in sections and/or inclined with respect to a radial direction of the ventilator.

Generally, it is to be pointed out that an application having the same title is filed by Applicant today, the content of which, in particular as regards the environment of the protection grid, i.e. a frame, a ventilator and/or a ring deflecting the backflow, for example, is made the subject matter of the present application. In other words, all details described therein are applicable to the subject matter of the present application and U.S. patent application Ser. No. 18/462,946 is incorporated herein by reference in its entirety, in particular, but not limited to said components.

BRIEF DESCRIPTION OF THE DRAWINGS

Preferred embodiment examples of the invention will be explained in more detail below with reference to the drawings. The drawings show the following:

FIG. 3 shows a perspective sectional view of the protection grid of the first embodiment;

FIG. 4 shows a perspective sectional view of a second embodiment of the protection grid;

FIG. 5 shows another perspective sectional view of the second embodiment of the protection grid;

FIG. 6 shows a perspective sectional view of a third embodiment of the protection grid;

FIGS. 10 to 12 show sectional views of further profiles of ribs of the protection grid.

DETAILED DESCRIPTION OF EMBODIMENTS

Figure 1:
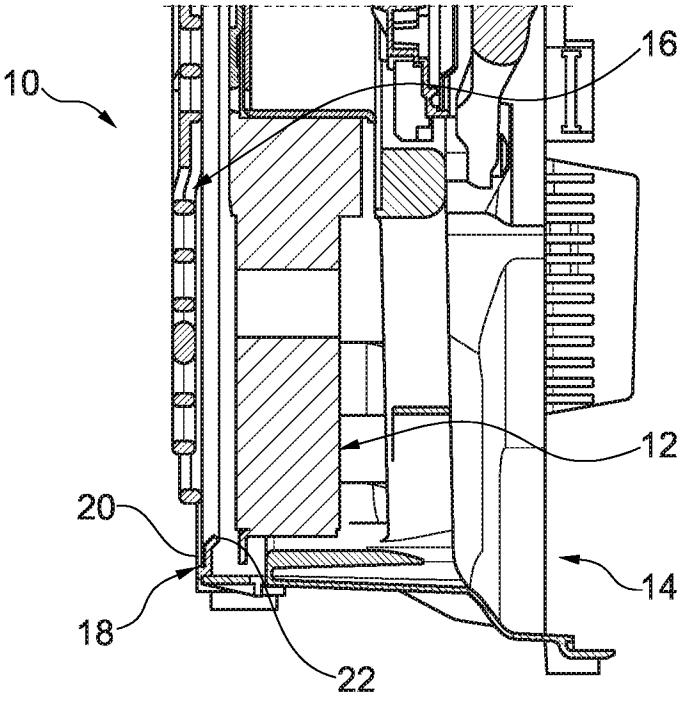
FIG. 1 shows a sectional view of a first embodiment.

As apparent from FIG. 1, the fan 10 according to the invention comprises a ventilator 12 surrounded by a frame 14. The flow direction created by the ventilator 12 extends from the left to the right in FIG. 1, and a protection grid 16 is provided upstream of the ventilator 12.

As apparent from the lower edge of FIG. 1, a ring 18 is integrated into the protection grid 16, which deflects a backflow extending from the right to the left in FIG. 1 and occurring in particular radially outside, i.e. at the lower edge in FIG. 1, in the direction of the flow direction created by the ventilator 12. For this purpose, the ring firstly has a portion 20 extending radially, i.e. from the top to the bottom in FIG. 1, and a portion 22 creating the described deflection and extending in an inclined manner in the axial direction in the shown case. In the shown embodiment, it is shorter than the radial portion 20, but ensures the advantageous deflection of the backflow.

Figure 2:
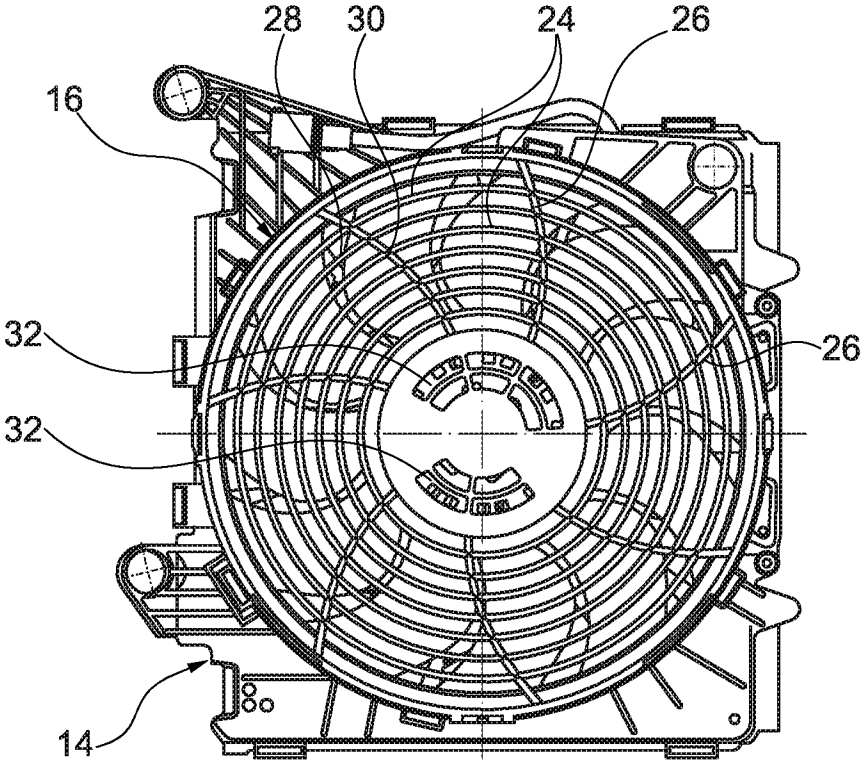
FIG. 2 shows a plan view of the first embodiment.

In FIG. 2, the protection grid 16 is particularly apparent in the plan view, which comprises a plurality of concentric ribs 24 and a plurality of essentially radially extending ribs 26. In the shown embodiment, the radially extending ribs are curved. In particular, they extend essentially in the radial direction on the inside, while on the outside they are at an angle to the radial direction.

As further apparent from FIG. 2, in the shown case, all radial ribs are curved or crescent-shaped in the same direction, and said curved shape or crescent shape extends to the left at the top of FIG. 2. As regards the ventilator 12 located therebelow and in particular the front edges 28, it is apparent with respect to the flow direction of the blades 30 of the ventilator that they are curved or crescent-shaped in the other direction. It has turned out that the noise generation can be kept low with this design.

It is to be noted that the protection grid 16 can also be configured differently, in particular in its central area. For example, the openings 32 that can be seen there in FIG. 2 can be configured to be larger in both the circumferential and the radial direction. In particular, they can extend over the entire circumference, and/or merely a small closed portion can remain in the center of the essentially circular protection grid 16.

FIG. 3 shows a sectional view of several concentric ribs 24, from which the essentially oval cross-sectional design is apparent. In the shown case, the longitudinal axes of the ovals are parallel to each other and aligned in the flow direction (in FIG. 1 from the left to the right, in FIG. 2 perpendicular to the drawing plane and in FIG. 3 from the top to the bottom). Furthermore, in the shown case, according to all figures, the concentric ribs 24 are equally spaced apart from each other in the radial direction.

Figure 7:
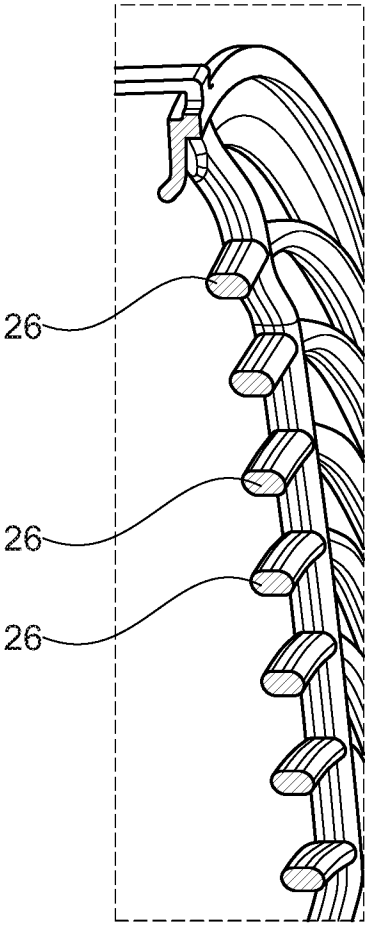
FIG. 7 shows a perspective sectional view of a fourth embodiment of the protection grid.

This also applies to the alternative embodiment shown in FIG. 4, in which all ribs 24 are inclined in the same direction with respect to the flow direction. As apparent from FIG. 5 and FIG. 6, the inclination can be configured in both directions; however, it is apparent from FIG. 7 that in contrast to the illustration in FIG. 5 and FIG. 6 not all ribs 24 have to be located on the same level in the axial direction. Rather, it is shown for the uppermost rib 24 apparent from FIG. 7 that it can be located closer in the direction of the ventilator 12, as also apparent from the bottom of FIG. 1.

Figure 8:
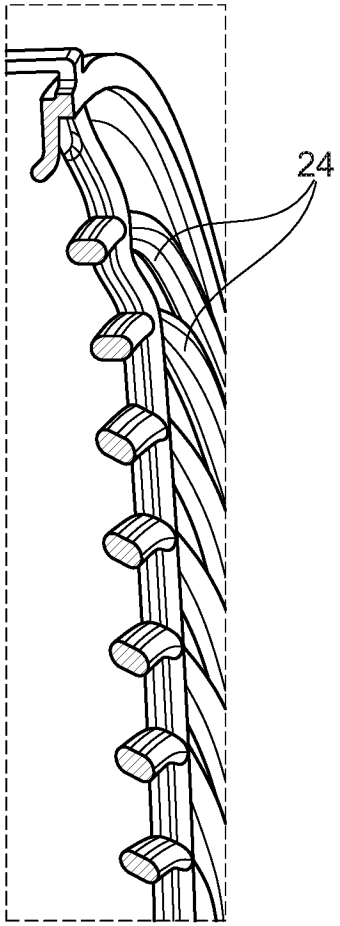
FIG. 8 shows a perspective sectional view of a fifth embodiment of the protection grid.

This also applies to the embodiment shown in FIG. 8, in which the longitudinal axes of the oval cross-sections of the two upper, i.e. radially outermost, ribs 24 are essentially parallel to the flow direction, but the radially inner ribs are inclined, in this case upstream, i.e. to the right in the figure, inwards, according to the alignment in the figure downwards.

Figure 9:
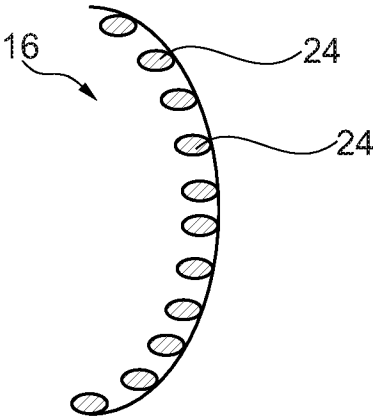
FIG. 9 shows a sectional view of a sixth embodiment of the protection grid.

As indicated in FIG. 9, the protection grid 16 can not only be curved or inclined in its radially outermost portion, but as a whole so that an arched or dome-shaped design results.

In FIGS. 10 to 12, further possible profiles for the ribs, including the radial ribs 26, are shown. According to FIG. 12, it is a crescent shape. According to FIG. 10, the upper and lower sides are arched, but asymmetrical with respect to each other, in that according to FIG. 10 the upper side is both arched more strongly and the arch is not shaped symmetrically to a central axis extending in FIG. 10 from the top to the bottom, but essentially to the left thereof. To some extent, this also applies to the profile shown in FIG. 11, in which the lower side, however, has a more pronounced arch so that the shape approximates the cross-section apparent from FIGS. 3, 4, 7 and 8.

What is claimed is:

1. A fan for a heat exchanger of a vehicle, the fan comprising a ventilator and a protection grid upstream of the ventilator, wherein the protection grid further comprises a plurality of radial ribs and a plurality of concentric ribs, wherein blades of the ventilator are bent to curve in only a first circumferential direction arranged perpendicular to a radial direction of the ventilator as the blades extend radially outwardly away from an axis of rotation of the ventilator, and wherein at least one of the radial ribs extends so as to be curved or crescent-shaped with the at least one of the radial ribs curving along its major axis in a second circumferential direction arranged perpendicular to the radial direction of the ventilator and opposite the first circumferential direction as the at least one of the radial ribs extends radially outwardly away from the axis of rotation of the ventilator.

2. The fan according to claim 1, wherein at least one of the concentric ribs has an oval cross-section.

3. The fan according to claim 2, wherein a longitudinal axis of the oval cross-section has an angle with respect to a direction of flow.

4. The fan according to claim 2, wherein longitudinal axes of a plurality of the oval cross-sections are parallel to each other.

5. The fan according to claim 1, wherein at least one of the radial ribs or at least one of the concentric ribs has a crescent-shaped cross-section or an oval, but asymmetrical cross-section.

6. The fan according to claim 5, wherein the cross-section is asymmetrical with regard to a position or an extent of a bulge on an upper side and a lower side.

7. The fan according to claim 1, wherein at least one of the concentric ribs or at least one of the radial ribs in cross-section has a width of 4.0 mm to 4.2 mm and a height of 6.0 mm to 6.4 mm.

8. The fan according to claim 1, wherein a number of the radial ribs is different from a number of blades of the ventilator.

9. The fan according to claim 1, wherein the protection grid extends so as to be curved at least in sections or inclined with respect to the radial direction of the ventilator.

10. The fan according to claim 1, wherein a front edge of each of the blades of the ventilator is bent to curve in the first circumferential direction as each of the respective front edges extends radially outwardly away from the axis of rotation of the ventilator.

* * * * *